US009791169B2

(12) United States Patent
Uchida et al.

(10) Patent No.: US 9,791,169 B2
(45) Date of Patent: Oct. 17, 2017

(54) LIQUID HEATER

(75) Inventors: Minoru Uchida, Tokyo (JP); Haruyoshi Yamakawa, Tokyo (JP); Naoki Matsumoto, Tokyo (JP)

(73) Assignee: KURITA WATER INDUSTRIES LTD. (JP)

( * ) Notice: Subject to any disclaimer, the term of this patent is extended or adjusted under 35 U.S.C. 154(b) by 250 days.

(21) Appl. No.: 14/088,693

(22) PCT Filed: May 24, 2012

(86) PCT No.: PCT/JP2012/063272
§ 371 (c)(1),
(2), (4) Date: Nov. 25, 2013

(87) PCT Pub. No.: WO2012/161247
PCT Pub. Date: Nov. 29, 2012

(65) Prior Publication Data

US 2014/0079377 A1 Mar. 20, 2014

(30) Foreign Application Priority Data

May 26, 2011 (JP) ..... 2011-117764

(51) Int. Cl.
*F24H 1/12* (2006.01)
*F24H 1/14* (2006.01)
(Continued)

(52) U.S. Cl.
CPC ..... *F24H 1/121* (2013.01); *F24H 1/142* (2013.01); *F24H 9/0015* (2013.01); *F24H 9/2028* (2013.01)

(58) Field of Classification Search
CPC ..... F24H 1/121; F24H 1/142
See application file for complete search history.

(56) References Cited

U.S. PATENT DOCUMENTS 5,054,107 A * 10/1991 Batchelder ..... F24H 1/121 392/483
5,054,108 A * 10/1991 Gustin ..... H05B 3/44 392/422
(Continued)

FOREIGN PATENT DOCUMENTS

JP S62-088390 6/1987
JP 2010-060147 A1 3/2010
(Continued)

OTHER PUBLICATIONS

Notification of Reasons for Refusal issued in corresponding Korean Application No. 2013-7026101 dated Jan. 29, 2015.
(Continued)

*Primary Examiner* — Tu B Hoang
*Assistant Examiner* — Erin McGrath
(74) *Attorney, Agent, or Firm* — Scarinci Hollenbeck

(57) ABSTRACT

The invention is directed to a liquid heater for rapidly heating a liquid without overheating the liquid. The liquid heater comprises a liquid flow channel having a passage through which liquid flows, a heating part disposed outside the liquid flow channel, a heat reflecting part facing a heat radiating side of the heating part, and a cooling part through which a cooling medium flows adjacent a reverse side of a reflecting surface of the heat reflecting part for cooling the heat reflecting part. Radiant heat not absorbed in the liquid is reflected by the heat reflecting part. The heat reflecting part reflects radiant heat cooled by the cooling part so that the body of the liquid heater and peripheral members are maintained at a temperature not higher than a predetermined temperature to prevent overheating the liquid.

7 Claims, 13 Drawing Sheets

(a) (b)

(51) Int. Cl.
*F24H 9/00* (2006.01)
*F24H 9/20* (2006.01)

(56) References Cited

U.S. PATENT DOCUMENTS

| | | | | |
|---|---|---|---|---|
| 7,149,084 | B2 * | 12/2006 | Matsushima | G06F 1/20 165/80.4 |
| 2011/0194846 | A1 * | 8/2011 | Wang | H05B 3/42 392/482 |

FOREIGN PATENT DOCUMENTS

| | | |
|---|---|---|
| KR | 10-2005-0081816 | 8/2005 |
| TW | 201015032 | 4/2010 |

OTHER PUBLICATIONS

Notification of Reasons for Refusal issued in corresponding Japanese Application No. 2011-117764 dated Apr. 22, 2015.

* cited by examiner (a)

(b)

(a) (b)

(a)

(b)

PRIOR ART

LIQUID HEATER

FIELD OF THE INVENTION

The present invention relates to a liquid heater that rapidly heats liquid.

BACKGROUND

In a resist peeling process in the manufacture of a semiconductor, a solution such as sulfuric acid is often heated and used at a high temperature as a cleaning liquid. Particularly, when a resist of a wafer is peeled by a single substrate processing washer using a electrolyzed sulfuric acid solution of which an active ingredient is persulphuric acid (peroxodisulfuric acid and peroxomonosulfuric acid) obtained by electrolysis of a sulfuric acid solution, the electrolyzed sulfuric acid solution should be rapidly (for about 5 to 10 seconds) heated from about 100° C. to a temperature of about 180° C. to 200° C. that is the service temperature in the washer. A rapid heater, which uses a near infrared heater, is proposed as a device used for this heating (see Patent Literature 1).

Generally, examples of the principle of heat transfer include (1) conduction, (2) convection, and (3) radiation.

In the rapid heater, heat needs to be transferred in a short time. Residence time in the device should be shortened to transfer heat to fluid, which has a constant flow rate, in a short time. Then, however, since a heat transfer area cannot be increased, it is not possible to transfer sufficient heat by a heat transfer method, such as (1) conduction or (2) convection. Accordingly, the rapid heater uses a method of making light be emitted from the near infrared heater and making the light be directly absorbed in molecules of the fluid, here, molecules of sulfuric acid or water. Further, the thickness of a liquid flow channel is reduced in order to shorten the residence time of liquid.

In a general heating device, the outer portion of the heating device is covered with a heat insulator so that heat is accumulated in the heating device and high temperature is maintained for high thermal efficiency. The outline of the heating device will be described with reference to FIG. 13.

A near infrared heater 101 is disposed outside a heat intended liquid flow channel 100, and a heat insulator 102 is disposed on the side opposite to the near infrared heater 101. Heat rays output from the near infrared heater 101 are emitted to the liquid-to-be-heated flow channel 100, so that a electrolyzed sulfuric acid solution flowing through the heat intended liquid flow channel 100 is rapidly heated by radiant heat. A high-temperature electrolyzed sulfuric acid solution flows out of the heat intended liquid flow channel 100.

CITATION LIST

Patent Literature

Patent Literature 1: JP 2010-060147 A

DISCLOSURE OF THE INVENTION

Problems to be Solved by the Invention

Here, the heat rays, which are not absorbed by the electrolyzed sulfuric acid solution, pass through the heat intended liquid flow channel and leak to the outside. However, since the heat intended liquid flow channel has a small internal volume and a small effective heat transfer area, heat absorbed by the heat insulator is not effectively transferred to the fluid and the temperature of the heat insulator rises and reaches a high temperature in the radiation heat transfer using near infrared heater. If an operation continues to be performed in this state, a temperature exceeds the heat resisting temperature of the heat insulator and an accident such as the melting of the device occurs. Further, if heat is radiated without being insulated, there is a problem in that a housing (which is commonly made of a vinyl chloride resin) in which the rapid heater is installed reaches a high temperature.

The invention has been made to solve the above-mentioned problem, and an object of the invention is to provide a liquid heater that gives high heat by radiant heat and can be safely and continuously operated by preventing heat intended liquid burns or melting that is caused when a body and peripheral members receive radiant heat and reaches a high temperature.

Means for Solving the Problem

That is, according to a first invention of the liquid heater of the invention, there is provided a liquid heater including: a liquid-to-be-heated flow channel through which heat intended liquid flows; a heating part that is disposed on one side of the heat intended liquid flow channel and can radiate heat toward the heat intended liquid flow channel so that a heat radiation direction crosses the liquid flow direction; a heat reflecting part that is disposed on the other side of the heat intended liquid flow channel; and a cooling part that cools the heat reflecting part, wherein the cooling part includes a cooling medium flow channel through which a cooling medium flows disposed at the reverse side of a reflecting surface of the heat reflecting part and which cools the heat reflecting part by the cooling medium.

According to a second invention, in the first invention, an outer cooling medium flow channel can be connected to an introduction side and a discharge side of the cooling medium flow channel, and the outer cooling medium flow channel corresponding to the discharge side may be provided with a second cooling part that cools the cooling medium.

According to a third invention, in the first or second invention, the heat intended liquid flow channel can be formed of a double pipe, one or two or more heating parts may be disposed inside an inner pipe of the double pipe, the heat reflecting part may be disposed outside an outer pipe of the double pipe, and the cooling part may be disposed outside the heat reflecting part.

According to a fourth invention, in any one of the first to third inventions, the cooling part can include a compressor that compresses air as the cooling medium and blows the compressed air into the cooling medium flow channel, and can include an air intake part that takes ambient air in and is provided between a blowing side of the compressor and an inlet side of the cooling medium flow channel.

According to a fifth invention, in the fourth invention, the outer cooling medium flow channel can be provided with an air fan that blows air supplied through the outer cooling medium flow channel toward the compressor.

According to a sixth invention, in any one of the first to third inventions, the heat intended liquid flow channel can be longitudinally disposed so that a liquid introduction side is positioned on the lower side and a liquid discharge side is positioned on the upper side, and may include an outer cooling medium flow channel that is connected to a liquid introduction side of the cooling medium flow channel and is provided with a pump sending liquid as the cooling medium;

the outer cooling medium flow channel may further include a cooling medium bypass bypassing the pump; and the cooling medium bypass may be provided with a valve that is closed while liquid is normally supplied through the outer cooling medium flow channel and is opened while the supply of liquid through the outer cooling medium flow channel is stopped or poor.

According to a seventh invention, in any one of the first to sixth inventions, the temperature of the liquid to be heated heat intended liquid can be in the range of 70 to 120° C., and may rise up to a temperature lower than a boiling point in the range of 140 to 220° C. while the heat intended liquid flows through the heat intended liquid flow channel.

According to an eighth invention, in any one of the first to seventh inventions, the thickness of the heat intended liquid flow channel in the heat radiation direction may be 10 mm or less.

Effects of the Invention

According to the invention, there is an effect of reflecting radiant heat that is not absorbed in the liquid, preventing burns or melting that is caused when heater body and peripheral members receive the radiant heat and become high temperature, and cooling the heat reflecting part reflecting the radiant heat so that the heater body and peripheral members are maintained at a temperature not higher than a predetermined temperature.

MODES FOR CARRYING OUT THE INVENTION

An embodiment of the invention will be described below.

Figure 1:
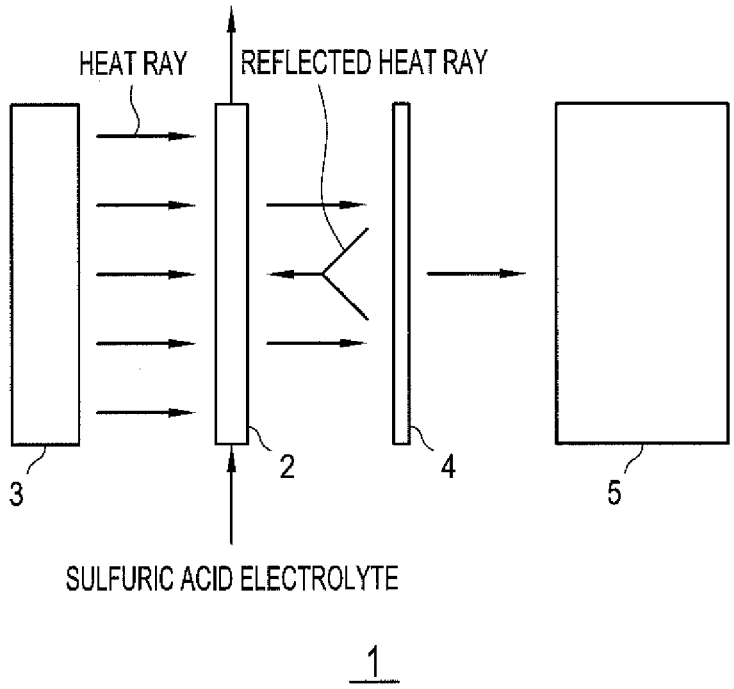
FIG. 1 is a diagram illustrating the outline of the structure of a device of the invention.

FIG. 1 is a diagram conceptually illustrating a liquid heater 1 of the invention, and will be described below.

The liquid heater 1 is used to clean an electronic material substrate (not illustrated) by rapidly heating a electrolyzed sulfuric acid solution while making the electrolyzed sulfuric acid solution flow. A electrolyzed sulfuric acid solution is obtained by electrolysis of sulfuric acid. A electrolyzed sulfuric acid solution is preliminarily heated to a temperature of 90 to 120° C. after being obtained by electrolysis of 65 to 96% by mass of a sulfuric acid solution at a temperature of 10 to 90° C. between electrodes of which at least an anode is a diamond electrode. A electrolyzed sulfuric acid solution is rapidly (for example, for 0.5 to 10 sec.) heated to a high temperature (for example, 140 to 220° C.) in the liquid heater 1, and is supplied to cleaning.

The liquid heater 1 includes a flat heat intended liquid flow channel 2, and the depth from a heating surface is 10 mm or less (preferably in the range of 1 mm to 5 mm). A near infrared heater 3 is disposed outside the flat surface of the heat intended liquid flow channel 2 as a heating part. Meanwhile, the heating part has only to release radiant heat, and is not limited to a specific heating part in the invention. For example, infrared light is not limited to near-infrared light, and light using a microwave or the like may be used.

A reflective plate 4 is disposed so as to face a heat radiating side of the liquid heater 1. The reflective plate 4 corresponds to a heat reflecting part of the invention. A reflecting surface of the reflective plate 4 faces the heat radiating side, and a cooling part 5 is disposed on the reverse side of the reflecting surface.

A electrolyzed sulfuric acid solution flows through the heat intended liquid flow channel 2, and radiation heat rays are released from the near infrared heater 3 at that time. Heat rays are emitted to the electrolyzed sulfuric acid solution that flows through the heat intended liquid flow channel 2, are absorbed in the electrolyzed sulfuric acid solution, and rapidly heat the electrolyzed sulfuric acid solution. Further, a part of the heat rays pass through the heat intended liquid flow channel 2 without being absorbed in the electrolyzed sulfuric acid solution. A part of the heat rays are absorbed in the reflective plate 4, and the other part of the heat rays are reflected by the reflective plate 4 and heat the electrolyzed sulfuric acid solution, which flows through the heat intended liquid flow channel 2, again. Accordingly, it is possible to increase the heat ray absorption rate of the electrolyzed sulfuric acid solution. Meanwhile, if a second reflective plate (not illustrated) is further disposed on the side opposite to the heat intended liquid flow channel 2 with the near infrared heater 3 interposed therebetween, the heat rays that are released from the near infrared heater 3 to the side opposite to the reflective plate 4 and a part of the heat rays that are reflected by the reflective plate 4 and reach the second reflective plate (not illustrated) without being absorbed in the electrolyzed sulfuric acid solution can be further reflected by the second reflective plate.

The reflective plate 4 is heated by absorbing a part of the heat rays, but is cooled by a cooling medium that is introduced into the cooling part 5. Accordingly, an excessive temperature rise of the reflective plate 4 is suppressed and the reflective plate 4 is maintained at a temperature not higher than a predetermined temperature. That is, since a place to which heat is to be dissipated is provided, the excessive temperature rise of the reflective plate and peripheral members can be avoided.

Meanwhile, as a cooling method, there are typically three methods, that is, (1) air cooling, (2) water cooling, and (3) air-water cooling. However, the cooling method of the invention is not limited to these methods.

(1) Air cooling is a method using air as a cooling medium.

(2) Water cooling is a method using water as a cooling medium.

(3) Air-water cooling is a method that uses air as a cooling medium, cooled by water, and circulates and uses the air. Characteristics are as follows:

(1) Air cooling: there is a demerit that the exhaust air flow rate from a device is high, but the structure of the device is simple.

(2) Water cooling: there is a merit that the installation area of the device can be reduced since the device is compact, but it is necessary to contrive the liquid heater so that cooling water is not boiled at the time of the emergency stop of the supply of cooling water.

(3) Air-water cooling: an exhaust air flow rate is low, it is advantageous in terms of utility consumption, and there is no concern about boiling. However, the structure of the device is complicated and the installation area of the device is increased.

Since there are advantages and disadvantages as described above, it is necessary to select an appropriate method in accordance with the situation. Examples of liquid heaters employing the respective cooling methods will be described below.

(1) Air Cooling Method

An air-cooled liquid heater 10 of an embodiment will be described. The liquid heater 10 has a cylindrical shape as a whole. As illustrated in FIG. 2A, a columnar near infrared heater 11 is disposed at the central portion of the liquid heater 10, and a heat intended liquid flow channel 12 having a ring-shaped cross-section, a cylindrical reflective plate 13, and a cylindrical outer protective pipe 15 are concentrically disposed in this order toward the outside.

The heat intended liquid flow channel 12 is formed of a gap between an outer pipe and an inner pipe that form a double-pipe structure. The thickness (a difference between the outer and inner diameters) of the heat intended liquid flow channel 12 is preferably in the range of 1 to 5 mm.

An ventilation channel 14 through which air as a cooling medium flows is secured between the reflective plate 13 and the outer protective pipe 15, and the ventilation channel 14 corresponds to a cooling medium flow channel of the invention and forms a part of the cooling part of the invention. Meanwhile, the heat intended liquid flow channel 12 has had a ring-shaped cross-section in this embodiment, but a plurality of heat intended liquid flow channels may be disposed on the circumference of a circular cross-section.

Further, FIG. 2B is a diagram illustrating a modification of a liquid heater 20, and the same portions as the portions of FIG. 2A are denoted by the same reference numerals.

The liquid heater 20 includes a columnar heat intended liquid flow channel 21 that is formed at the central portion thereof by a cylindrical pipe line, and a plurality of columnar near infrared heaters 22 are disposed along the circumference of the heat intended liquid flow channel 21 on the outer peripheral side of the heat intended liquid flow channel 21. A cylindrical reflective plate 13 and a cylindrical outer protective pipe 15 are concentrically disposed in this order on the outer peripheral side of the circumference along which the near infrared heaters 22 are disposed. In a large-sized heater (when a liquid flow rate is high), a lot of heaters are needed and a heater may not be disposed at the central portion of the large-sized heater. In this case, it is effective that heaters are disposed on the outer peripheral side of the heat intended liquid flow channel 21 as illustrated in FIG. 2B.

Even in this modification, a ventilation channel 14 is secured between the reflective plate 13 and the outer protective pipe 15. Meanwhile, since liquid is uniformly heated from the outer periphery of the heat intended liquid flow channel 21 shaped circular cylinder, the width of the flow channel is preferably 10 mm or less (more preferably in the range of 1 mm to 5 mm).

Meanwhile, for example, a quartz plate, which is coated with gold, may be used as the material of the reflective plate 13. Among various metals, gold has very high reflectance. However, if temperature becomes excessively high, the vapor pressure becomes high, so that gold is sublimated (vaporized). Accordingly, it is necessary to keep gold at an appropriate temperature. Metal other than gold can be used, but similar consideration is needed.

Next, the structure of the cooling part including the ventilation channel 14 will be described using the liquid heater 10 of FIG. 2A as an example with reference to FIG. 3A. FIG. 3 is an end view taken along line passing through the near infrared heater 11 in FIG. 2.

As illustrated in FIG. 3A, the liquid heater 10 is disposed so that the axial direction of the liquid heater 10 is longitudinally disposed along upper and lower direction, and includes a gap that is formed between the reflective plate 13 and the outer protective pipe 15 so as to extend in upper and lower direction. The gap forms the ventilation channel 14. Air nozzles 16, which blow air into the ventilation channel 14, are disposed on the introduction side that is the lower side of the ventilation channel 14. Air flow channels 16*a* are connected to the air nozzles 16. The air flow channels 16*a*, the air nozzles 16, and spaces between the ventilation channel 14 and air blowing portions of the air nozzles 16 form an outer cooling medium flow channel of the invention.

Figure 4:
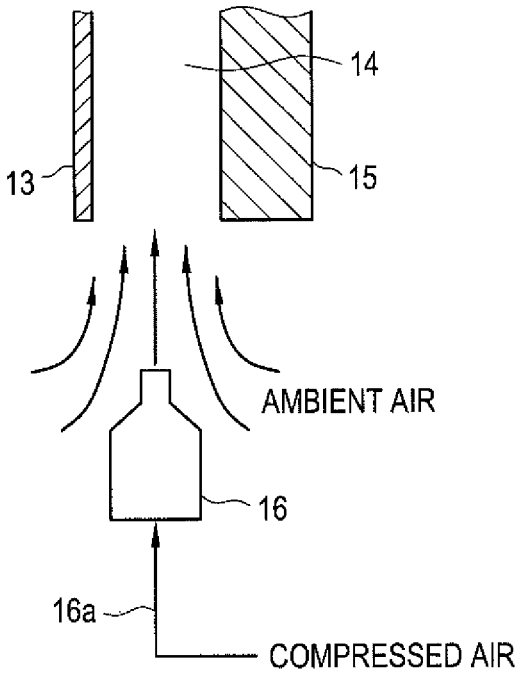
FIG. 4 is an enlarged end view of an air-blowing portion.

Meanwhile, a nozzle, which sucks ambient air by using compressed air as power in order to increase the air flow rate as illustrated in FIG. 4, may be used as the air nozzle 16. However, as long as the air nozzle efficiently blows air, the type of the air nozzle is not limited.

In the modification that uses compressed air, ambient air is sucked into the ventilation channel 14 from the outer peripheral side of the space between the air blowing portion of the air nozzle 16 and the ventilation channel 14 by the blowing of compressed air into the ventilation channel 14. Accordingly, a large amount of air is introduced into the ventilation channel 14, so that the reflective plate 13 is cooled. The air, which has cooled the reflective plate 13, is discharged to the surrounding space from the upper portion of the ventilation channel 14. Accordingly, the space around the air nozzles 16 functions as an air intake part of the invention. Meanwhile, a curtain or the like, which communicates with the ventilation channel 14, may be provided around the air nozzles 16 as an air intake part so that the intake of air is reliably performed.

Figure 2:
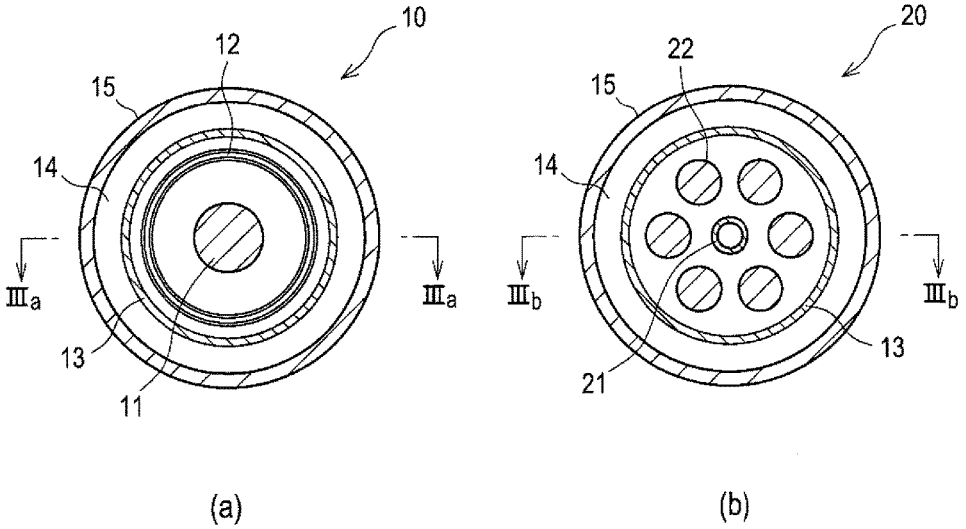
FIG. 2 is a lateral end view illustrating an example of an air-cooled liquid heater.

Next, the structure of the cooling part including the ventilation channel 14 of the liquid heater 20 of FIG. 2B as an example is illustrated in FIG. 3B. FIG. 3B is an end view taken along line IIIb-IIIb passing through the near infrared heater 11 in FIG. 2.

The liquid heater 20 is disposed so that the axial direction of the liquid heater 20 is longitudinally disposed along upper and lower direction, and includes a gap that is formed between the reflective plate 13 and the outer protective pipe 15 so as to extend in upper and lower direction. The gap forms the ventilation channel 14. Air nozzles 16, which blow air into the ventilation channel 14, are disposed on the introduction side that is the lower side of the ventilation channel 14. Air flow channels 16*a* are connected to the air nozzles 16.

An example in which the liquid heater 10 is installed in a housing 17 will be described with reference to FIG. 5.

Figure 3:
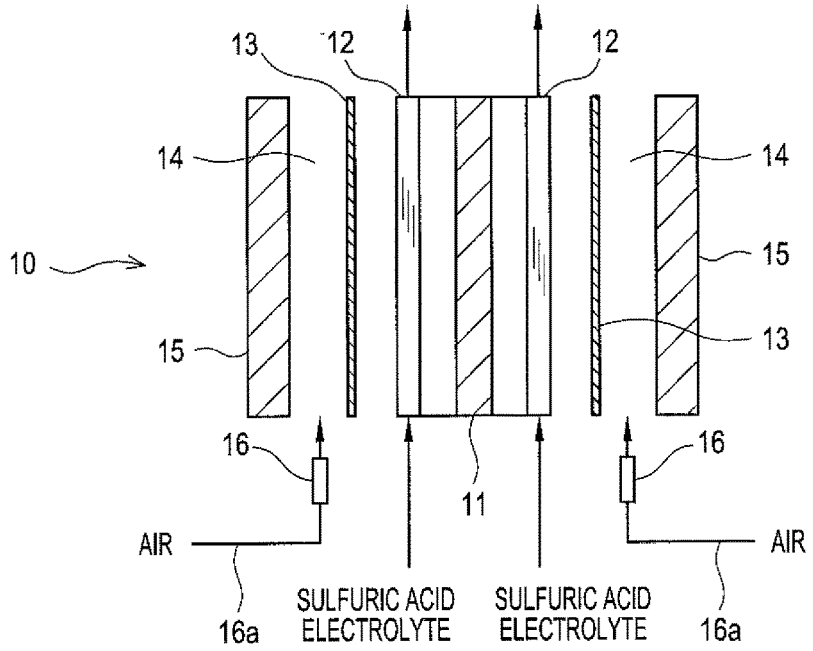
FIG. 3 is a longitudinal end view illustrating the example of an air-cooled liquid heater.
Figure 3:
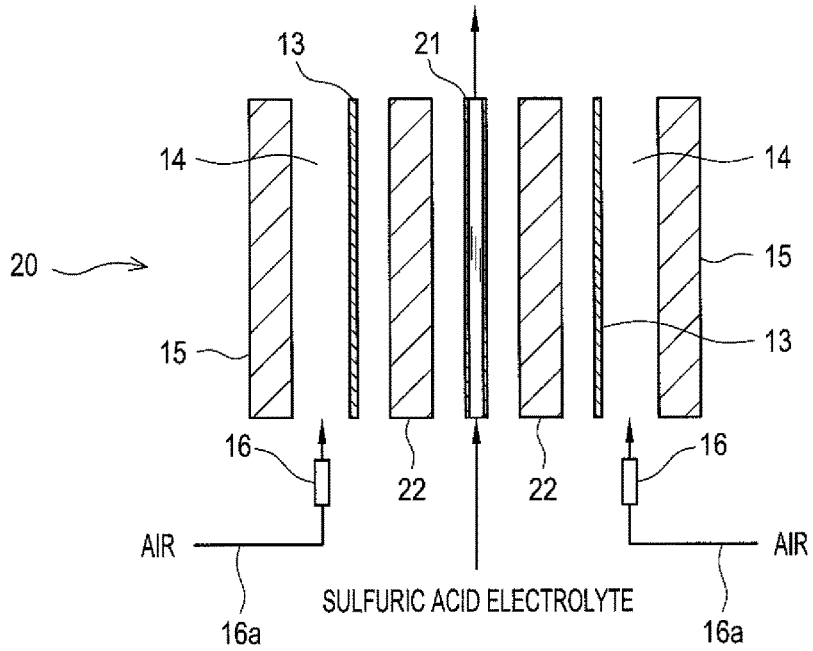
Figure 5:
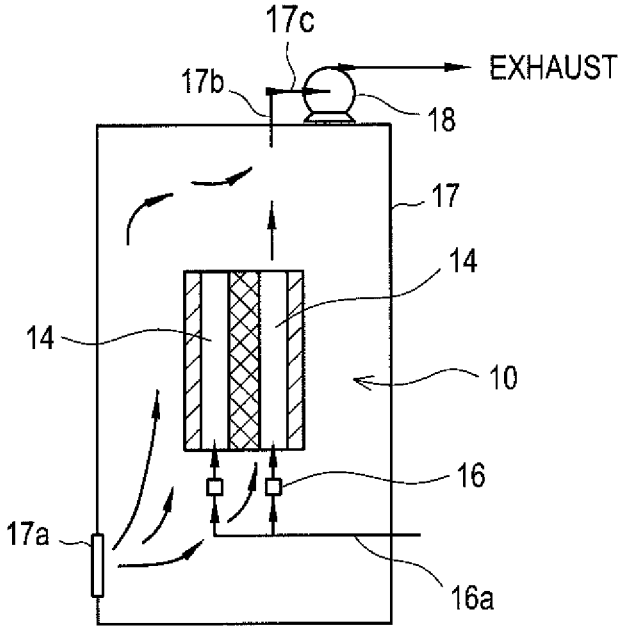
FIG. 5 is a diagram illustrating a structure that receives a liquid heater of an embodiment to cool the liquid heater by air.

Meanwhile, the structure of the liquid heater 10 is briefly illustrated in FIG. 5 on the basis of FIG. 3.

A louver 17*a* is provided at the lower portion of the housing 17, an exhaust part 17*b* is provided at the upper portion of the housing 17, and an exhaust fan 18 is connected to an exhaust channel 17*c* connected to the exhaust part 17*b*. Accordingly, most of cooling air is sucked into the housing 17 from the louver 17*a* by the operation of the exhaust fan 18, and is discharged to the outside of the housing 17 through the exhaust part 17*b* and the exhaust channel 17*c* while passing through the housing 17. It is preferable that compressed air be used as power that makes this air pass through the ventilation channel 14 between the reflective plate 13 and the outer protective pipe 15 as described above. Since the exhaust channel 17*c* is generally formed of a pipe that is made of a vinyl chloride resin, the heat resistance (service temperature) of the exhaust channel 17*c* is ensured up to 45° C. For this reason, it is necessary to lower the temperature of exhaust gas by making a large amount of air being sucked into the ventilation channel 14 by the air intake part that functions by the action of compressed air.

(2) Water Cooling Method

Next, a liquid heater, which includes a cooling part using a water cooling method, will be described with reference to FIGS. 6A and 6B and FIG. 7.

A liquid heater 30 illustrated in FIG. 6A includes a columnar near infrared heater 31 at the central portion thereof. A heat intended liquid flow channel 32 that has a ring-shaped cross-section and is formed of a gap formed between pipes of a double pipe, a cylindrical reflective plate 33, and a water-cooling jacket 34 having a ring-shaped cross-section are concentrically disposed in this order on the outer peripheral side of the near infrared heater 31. The water-cooling jacket 34 is a part in which cooling water flows, and corresponds to a cooling part of the invention. Meanwhile, the reflective plate 33 and the water-cooling jacket 34 may be separately produced and may be disposed so as to come into contact with each other. Alternatively, the inside of the water-cooling jacket 34 may be plated with a reflective material such as gold so that the reflective plate 33 is formed on the inside of the water-cooling jacket 34. The reflective plate 33 corresponds to the heat reflecting part of the invention.

A liquid heater 40 illustrated in FIG. 6B is a modification using a water cooling method. Meanwhile, the same portions as the portions of FIG. 6A are denoted by the same reference numerals in the description and will be explained.

The liquid heater 40 includes a heat intended liquid flow channel 41 that is formed at the central portion thereof by a cylindrical pipe line, and a plurality of columnar near infrared heaters 42 are disposed along the circumference of the heat intended liquid flow channel 41 on the outer peripheral side of the heat intended liquid flow channel 41. A cylindrical reflective plate 33 and a water-cooling jacket 34 are concentrically disposed on the outer peripheral side of the circumference along which the near infrared heaters 42 are disposed.

Figure 6:
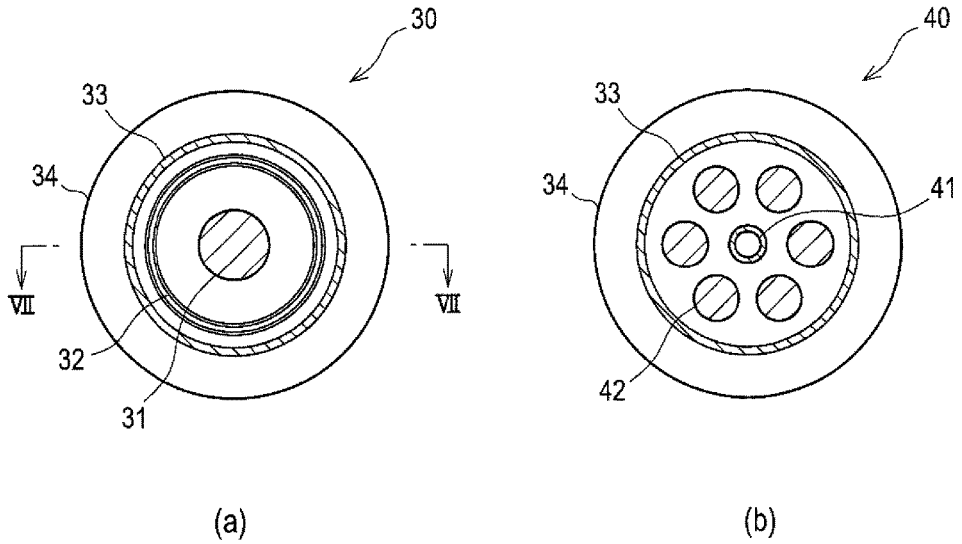
FIG. 6 is a lateral end view illustrating another example of a water-cooled liquid heater.

Next, the structure of the cooling part including the water-cooling jacket 34 will be described using the liquid heater 30 of FIG. 6A as an example with reference to FIG. 7. FIG. 7 is an end view taken along line VII-VII passing through the near infrared heater 31 in FIG. 6.

Figure 7:
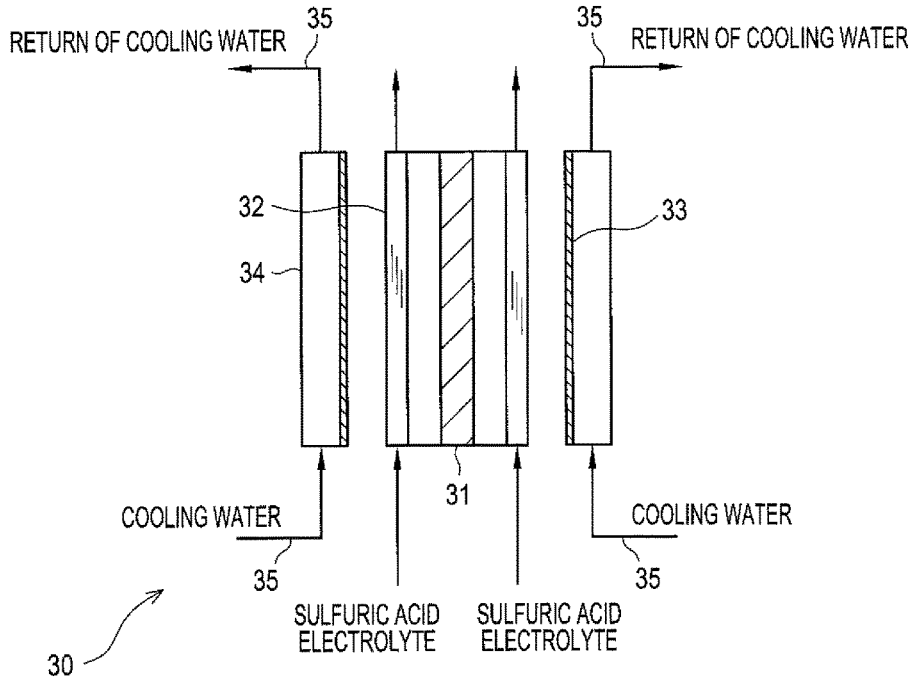
FIG. 7 is a longitudinal end view of the example of a water-cooled liquid heater.

As illustrated in FIG. 7, the water-cooling jacket 34 is disposed in the heater 30 so as to come into close contact with the outer peripheral surface of the reflective plate 33. The feeding sides of outer cooling water channels 35 are connected to a lower portion of the water-cooling jacket 34, and the return sides of the outer cooling water channels 35 are connected to an upper portion of the water-cooling jacket 34. The outer cooling water channels 35 correspond to the outer cooling medium flow channel of the invention. Since cooling water is circulated by a pump (not illustrated) that is provided on the outer cooling water channel 35, cooling water flows in the water-cooling jacket 34. Accordingly, the reflective plate 33 can be cooled.

Since the heat capacity of water per unit volume is larger than the heat capacity of air per unit volume, water can remove the same amount of heat at a lower flow rate. This is a merit, but a demerit is that there is a concern that water present in the water-cooling jacket is boiled and causes a trouble when the supply of cooling water is stopped due to a trouble or the like. In order to prevent this, it is necessary to increase the size of the water-cooling jacket so that the amount of water present in the water-cooling jacket becomes sufficiently large or to contrive a water-cooling jacket that circulates water in another method. Since the weight of the device is increased if the size of the water-cooling jacket is increased, it is inconvenient to handle the device.

Figure 8:
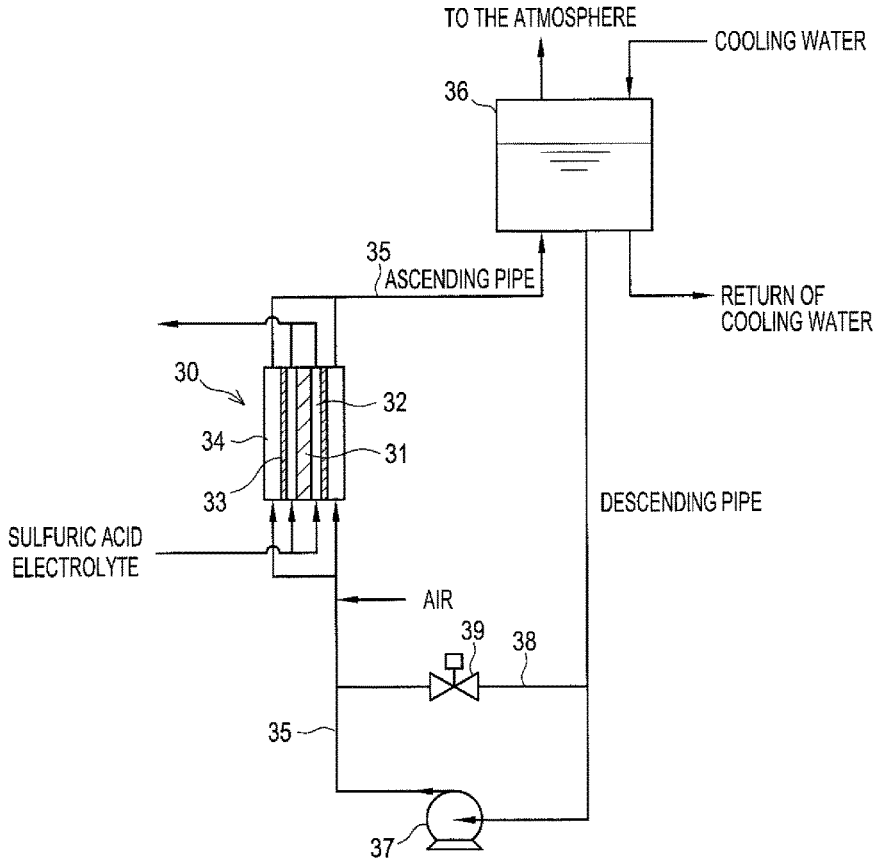
FIG. 8 is a diagram illustrating a structure that includes a liquid heater of an embodiment to cool the liquid heater by water.

Accordingly, a structure that includes, for example, a safety mechanism illustrated in FIG. 8 is considered. The structure of the liquid heater 30 is briefly illustrated in FIG. 8.

That is, the outer cooling water channel 35 is provided with a cooling water tank 36 and a pump 37 is provided on the downstream side of the cooling water tank 36. The cooling water tank 36 is installed at a position above the liquid heater 30. Further, a cooling water bypass 38, which bypasses the pump 37, is provided at the outer cooling water channel 35 on the downstream side of the cooling water tank 36, and the cooling water bypass 38 is provided with a valve 39. When cooling water normally flows through the outer cooling water channel 35, the valve 39 is closed. When cooling water is not supplied to the water-cooling jacket 34 due to the breakdown of the pump 37, a blackout, or the like or the amount of cooling water to be supplied is significantly reduced, the valve 39 is opened. The opening/closing of the valve 39 may be performed on the basis of the flow rate or pressure of cooling water flowing in the outer cooling water channel 35, or can be performed by the control of a controller or the like. In the control of the controller, the flow rate or the like of cooling water flowing in the outer cooling water channel 35 is detected and a control can be performed on the basis of a result of the detection. Furthermore, a mechanism, which closes the valve 39 in a normal conducting state and opens the value 39 by an energization member or the like when the supply of current is unexpectedly stopped due to a blackout, can be provided. For example, a fail-open valve can be selected.

Accordingly, the valve 39 is opened when the supply of cooling water is poor, and cooling water of which the temperature further rises in the water-cooling jacket 34 is moves up due to buoyancy. Therefore, cooling water can be circulated through the cooling water bypass 38 by natural circulation. When the flow rate of cooling water to be circulated is low, air may be blown from the lower portion of the water-cooling jacket 34 to increase buoyancy. Even when the supply of air is stopped and a part of water present in the water-cooling jacket 34 is boiled, large buoyancy is generated by boiling. Accordingly, if water is present in the cooling water tank 36, the water is circulated. That is, a difference between the density of water, which moves down, and the density of water, which moves up, in the flow channel is used. It is important that a sufficient amount of water is ensured in the cooling water tank.

Since the temperature of the cooling water tank 36 rises when an operation is continued in the above-mentioned structure, it is possible to keep the temperature of the cooling water tank 36 constant by receiving cooling water into the cooling water tank 36 from the outside at any time and returning cooling water.

(3) Air-Water Cooling Method

An air-water cooling method is considered as a good method that does not generate a large amount of exhaust gas unlike the air cooling method and does not have a concern about the boiling of water occurring at the time of the loss of utility unlike the water cooling method.

Figure 9:
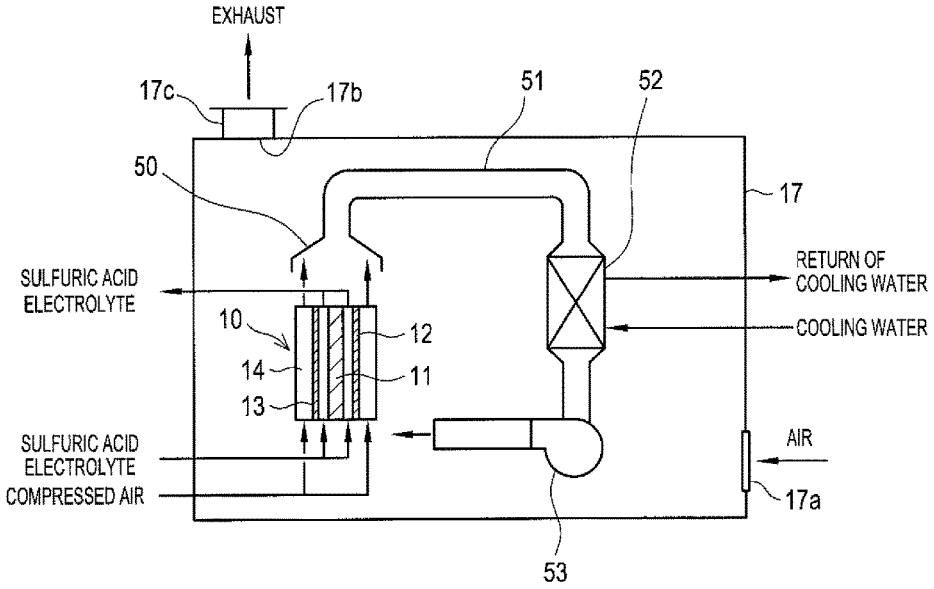
FIG. 9 is a diagram illustrating an example of an air-water-cooled liquid heater.

A portion, which cools the liquid heater, is the same as that of the air cooling method, but air heated to high temperature is cooled by cooling water and is circulated and used. It is appropriate that an air fin cooler is used as a unit efficiently cooling air. This method is illustrated in FIG. 9. In this embodiment, description will be made using the liquid heater 10 as an example. Meanwhile, the same portions as the portions of the embodiment are denoted by the same reference numerals in the description and will be explained. Further, the structure of the liquid heater 10 is briefly illustrated in FIG. 9.

That is, the liquid heater 10 is disposed in a housing 17 that includes a louver 17*a*, an exhaust port 17*b*, and an exhaust channel 17*c*.

A hood 50 is disposed above the liquid heater 10, so that air having passed through the ventilation channel 14 and released to the upper side is sucked. An outer air channel 51 is connected to the hood 50, and the outer air channel 51 is provided with an air fin cooler 52. Cooling water is supplied to the air fin cooler 52, so that the air fin cooler 52 cools the air, which passes through the outer air channel 51, by water. The outer air channel 51 corresponds to the outer cooling medium flow channel of the invention, and the air fin cooler 52 corresponds to a second cooling part of the invention.

An air circulation fan 53 is connected to the downstream end of the outer air channel 51, so that the air circulation fan 53 blows air, which has passed through the outer air channel 51 and been cooled by the air fin cooler 52, to the introduction-side space of the ventilation channel 14.

Accordingly, when compressed air is introduced into the ventilation channel 14, air is blown by the air circulation fan 53. The air circulation fan 53 corresponds to an air fan of the invention. A large amount of cooled air is taken into the ventilation channel 14, and effectively cools the inside of the liquid heater 10, particularly, the reflective plate 13. After air, which has been used for cooling in the liquid heater 10 and of which temperature has risen, is recovered by the hood 50, passes through the outer air channel 51, and is cooled by the air fin cooler 52, the air is supplied to the introduction side of the ventilation channel by the air circulation fan 53. Accordingly, air-water cooling continues to be performed.

In this embodiment, even though the supply of cooling water or compressed air is stopped due to a blackout or the like, the boiling of water does not occur since water present in the air fin cooler 52 does not come into contact with a high-temperature portion. The temperature of the inside of the liquid heater 10 is lowered by natural heat dissipation. Air is sucked from the louver 17*a* by natural ventilation, and is discharged to an exhaust duct.

Example 1

Examples of the invention and Comparative Examples using different cooling methods will be described below.

EXAMPLES OF THE INVENTION (1) Air Cooling Method

The method of the invention was performed using the heater having the structure illustrated in FIGS. 2B and 3B, the nozzles illustrated in FIG. 4, and the structure of the device illustrated in FIG. 5. Conditions and results were as follows:

Conditions

Lamp input: 18 kW

Thermal efficiency: 50% (efficiency calculated from a temperature rise of a sulfuric acid solution)

Cooling load: 9 kW (=18 kW*(100−50)/100)

Flow rate of compressed air: 500 NL/min

Temperature outside housing: 25° C.

Flow rate of exhaust air: 25 $m^3$/min

Results

Temperature of reflective plate=500° C.

Temperature of outer protective pipe=100° C.

Temperature of exhaust gas=44° C.

Evaluation

1. Temperature of reflective plate: the reflective plate is a quartz plate that is coated with gold. The maximum service temperature of quartz is 1000° C., and the sublimation (volatilization) of gold is not conspicuous if a temperature does not exceed 1000° C. In practice, it is thought that there is no problem at a temperature lower than 800° C.

2. Outer protective pipe: the material of the outer protective pipe is JIS SUS304 or ceramics. Accordingly, there is no problem on the material at 100° C. Since heat radiated to the housing from the outer protective pipe also corresponds to radiation from 100° C., the amount of heat is small. Accordingly, there is no problem.

3. Temperature of exhaust gas: the temperature of the exhaust gas is below the service temperature of a pipe made of a vinyl chloride resin (45° C.)

From the above, it was found that an operation could continue to be performed for a long time.

(2) Water Cooling Method

The method of the invention was performed using the heater having the structure illustrated in FIGS. 6A and 7 and the structure of the device illustrated in FIG. 8. Conditions and results were as follows:

Conditions

Lamp input: 12 kW

Thermal efficiency: 60% (efficiency calculated from a temperature rise of a sulfuric acid solution)

Cooling load: 4.8 kW (=12 kW*(100−60)/100)

Temperature of cooling water at inlet: 25° C.

Temperature of returned cooling water: 35° C.

Results

Surface temperature of reflective plate=100° C.

Flow rate of cooling water=6.9 L/min

Figure 10:
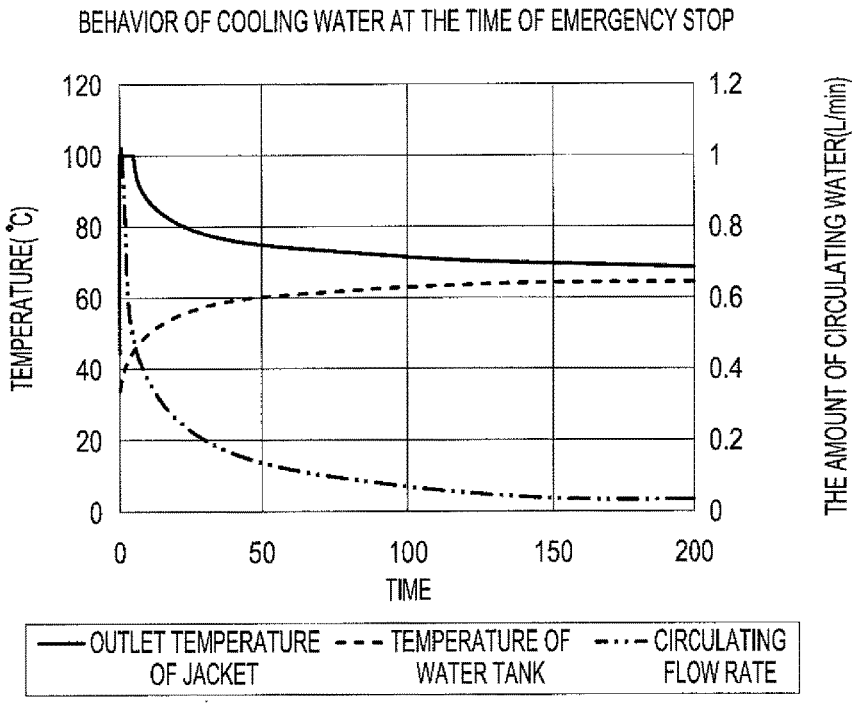
FIG. 10 is a graph showing a temperature change at the time of the emergency stop of a liquid heater of Example.

Results of Emergency Stop Test:

When a lamp was turned off from a normal operating state and a water cooling pump was stopped concurrently, a valve was opened and the natural circulation of water was started. At this time, the amount of water present in a cooling water tank was 20 L. The result of the measurement of a temperature change was illustrated in FIG. 10. Water present at an outlet of a water-cooling jacket was boiled for 5 minutes after the stop of the pump. However, the temperature of the water fell thereafter and became about 70° C. Further, the temperature of water present in the cooling water tank gradually rose and became about 65° C. after 3 hours.

Evaluation

1. Temperature of reflective plate: since the reflective plate directly contacted with the water-cooling jacket, the temperature of the reflective plate was low and the surface temperature of the reflective plate was 100° C. There was not problem on the device.
2. Flow rate of cooling water: 6.9 L/min is not a high flow rate for one sheet-type cleaning machine.
3. If the amount of water is 20 L, all cooling water is not boiled even though the pump is stopped. Accordingly, it was found that the device could be safely stopped.

From the above, it was found that an operation could continue to be performed for a long time and the entire device could be safely stopped even though the cooling water pump was stopped.

(3) Air-Water Cooling Method

The method of the invention was performed using the heater having the structure illustrated in FIG. 23, the nozzles illustrated in FIG. 4, and the structure of the device illustrated in FIG. 9. Conditions and results were as follows:

Conditions

Lamp input: 18 kW

Thermal efficiency: 50% (efficiency calculated from a temperature rise of a sulfuric acid solution)

Cooling load: 9 kW (=18 kW*(100−50)/100)

Flow rate of compressed air: 500 NL/min

Temperature outside housing: 25° C.

Flow rate of exhaust air: 2 $m^3$/min

Temperature of cooling water at inlet: 25° C.

Temperature of returned cooling water: 35° C.

Results

Temperature of reflective plate=500° C.

Temperature of outer protective pipe=100° C.

Temperature of exhaust gas=40° C.

Flow rate of cooling water=12.2 L/min

Evaluation

1. Temperature of reflective plate: the same as the air cooling method.
2. Outer protective pipe: the same as the air cooling method.
3. Temperature of exhaust gas: below the service temperature of a pipe made of a vinyl chloride resin (45° C.)
4. The amount of cooling water: an appropriate amount as the amount of cooling water used per sheet-type cleaning machine.

From the above, it was found that an operation could continue to be performed for a long time at an appropriate utility consumption.

COMPARATIVE EXAMPLE

(1) Comparative Example

Figure 11:
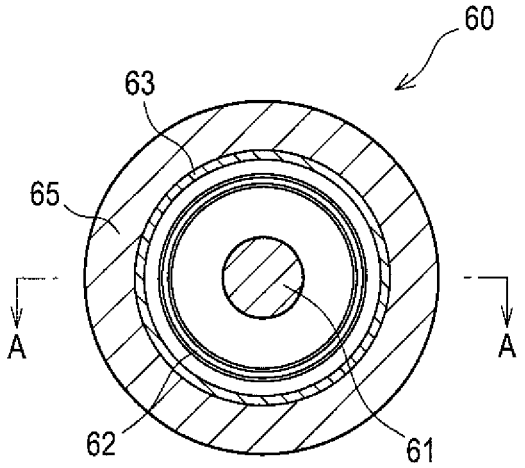
FIG. 11A is a lateral end view illustrating an example of a liquid heater of Comparative Example and FIG. 11B is a longitudinal end view thereof.
Figure 11:
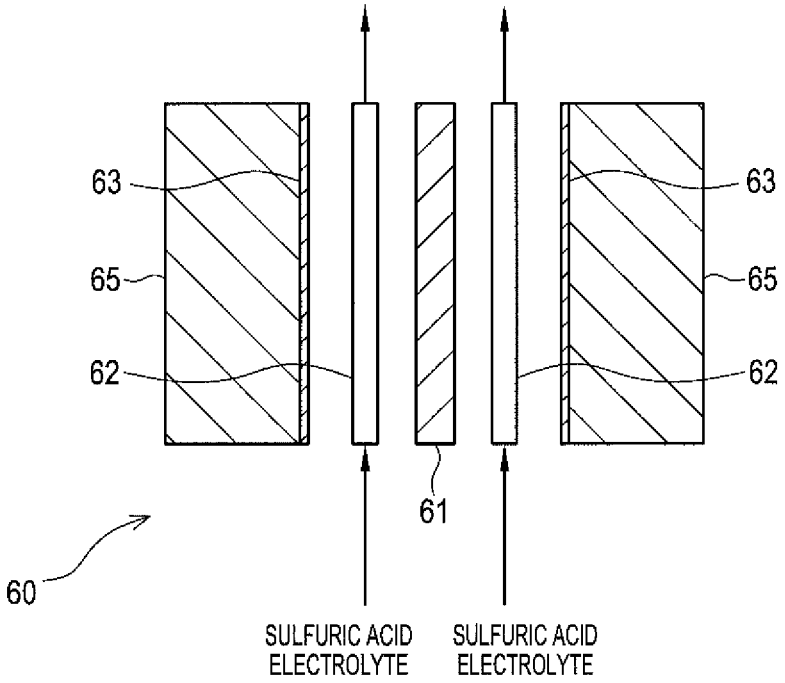
Figure 12:
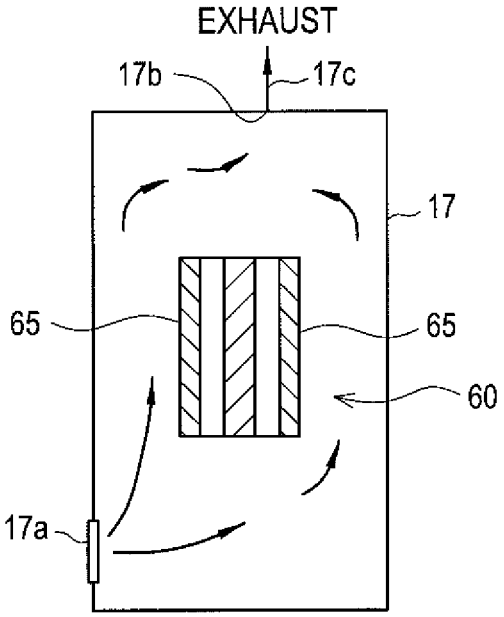
FIG. 12 is a diagram illustrating a structure that receives the liquid heater of Comparative Example to cool the liquid heater by air.
Figure 13:
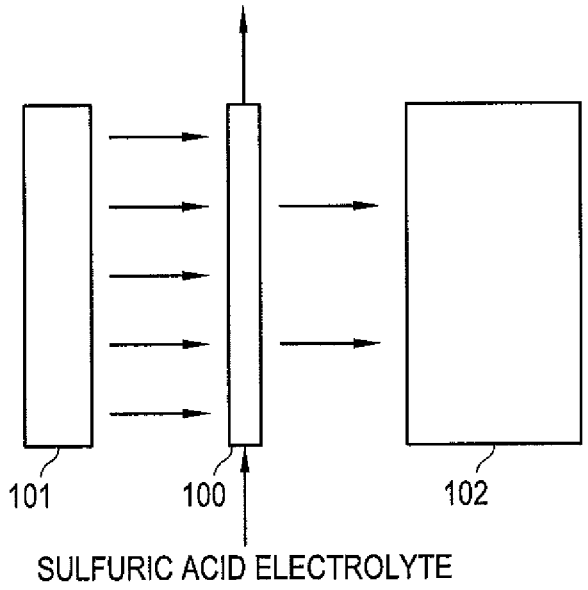
FIG. 13 is a longitudinal end view illustrating the outline of a liquid heater in the related art.

A liquid heater of which the outer surface of the reflective plate is covered with a heat insulator as illustrated in FIGS. 11A and 11B was used. Gore-Tex (registered trademark), which is one kind of Teflon (registered trademark), was used as the heat insulator. The structure of the entire device is illustrated in FIG. 12.

The structure of a liquid heater 60 of Comparative Example will be briefly described below.

A near infrared heater 61 is disposed at the central portion of a heat intended liquid flow channel 62 that is formed of a gap formed between pipes of a double pipe, a reflective plate 63 is disposed on the outer peripheral side of the liquid flow channel 62, and a tubular heat insulator 65 is disposed on the outer periphery of the reflective plate 63, so that the liquid heater 60 is formed. The liquid heater 60 is received in the above-mentioned housing 17.

Conditions and results of Comparative Example were as follows:

Conditions

Lamp input: 18 kW

Thermal efficiency: 50% (efficiency calculated from a temperature rise of a sulfuric acid solution)

Cooling load: 9 kW (=18 kW*(100−50)/100)

Temperature outside housing: 25° C.

Results

Before reaching a normal state, Gore-Tex (registered trademark) was melt and fume was generated. The heat resisting temperature of Teflon (registered trademark) is 260° C., but it is estimated that a temperature much exceeded 260° C.

Evaluation

A material having a higher heat resisting temperature should be used as the heat insulator. Alternatively, the device needs to be cooled.

(2) Comparative Example 2

The same liquid heater as Comparative Example 1 was used and the heat insulator was replaced with quartz wool that endures high temperature.

Conditions

The same as Comparative Example 1.

Results

A radiant heat ray penetrated the quartz wool, an outer cylinder (not illustrated), which fixes the quartz wool and is formed of a steel plate, was overheated, and fume was generated from paint (Teflon (registered trademark) coating) applied to the steel plate. Accordingly, it is estimated that a temperature reached a temperature much exceeding the heat resisting temperature of Teflon (registered trademark).

Evaluation

If much heat is present in the device even though a heat insulator, which endures very high temperature, is used, a temperature rises. Accordingly, it is necessary to cool the device to remove energy corresponding to heat rays, which are not absorbed in fluid, regardless of the type of a heat insulator, and it is not realistic.

DESCRIPTION OF THE REFERENCE NUMERAL

1 liquid heater
2 heat intended liquidflow channel
3 near infrared heater
4 reflective plate
5 cooling part
10 liquid heater
11 near infrared heater
12 heat intended liquid flow channel
13 reflective plate
14 ventilation channel
15 outer protective pipe
20 liquid heater
21 heat intended liquid flow channel
22 near infrared heater
30 liquid heater
31 near infrared heater
32 heat intended liquid flow channel
33 reflective plate

34 water-cooling jacket
35 outer cooling water channel
36 cooling water tank
38 cooling water bypass
39 valve
40 liquid heater
41 heat intended liquid flow channel
42 near infrared heater

The invention claimed is:

1. A liquid heater comprising:

a heat intended liquid flow channel having a first and second wall through which heat intended liquid flows in a liquid flow direction with the first wall being an inner wall and the second wall being an outer wall relative to a heating part disposed facing the first wall of the heat intended liquid flow channel for radiating heat toward the heat intended liquid flow channel so that a heat radiation direction crosses the liquid flow direction;

a heat reflecting part having one side thereof facing the second wall of the heat intended liquid flow channel on a side opposite the first wall and at a location separated and spaced apart from said second wall of the heat intended liquid flow channel such that no direct thermal conduction exists between the heat reflecting part and said second wall of the heat intended liquid flow channel;

a cooling part that cools the heat reflecting part, wherein the cooling part includes a cooling medium flow channel through which a cooling medium flows with the cooling medium flow channel facing the heat reflecting part on a side thereof opposite said one side of the heat reflecting part and being disposed in a substantially common direction with the longitudinal direction of the heat intended liquid flow channel for cooling the heat reflecting part by the cooling medium, and an outer cooling medium flow channel connected to an introduction side and a discharge side of the cooling medium flow channel with the outer cooling medium flow channel corresponding to the discharge side provided with a second cooling part that cools the cooling medium.

2. The liquid heater according to claim 1, wherein the heat intended liquid flow channel is formed of a double pipe, one or two or more heating parts are disposed inside an inner pipe of the double pipe, the heat reflecting part is disposed outside an outer pipe of the double pipe, and the cooling part is disposed outside the heat reflecting part.

3. The liquid heater according to claim 1, wherein the cooling part includes a compressor that compresses air as the cooling medium and blows the compressed air into the cooling medium flow channel, and includes an air intake part that takes ambient air in and is provided between a blowing side of the compressor and an inlet side of the cooling medium flow channel.

4. The liquid heater according to claim 3, wherein the outer cooling medium flow channel is provided with an air fan that blows air supplied through the outer cooling medium flow channel toward the compressor.

5. The liquid heater according to claim 1, wherein the heat intended liquid flow channel is longitudinally disposed so that the liquid introduction side is positioned on a lower side thereof and having the liquid discharge side thereof positioned on a side opposite said lower side, and with the outer cooling medium flow channel connected to the liquid introduction side of the cooling medium flow channel and provided with a pump sending liquid as the cooling medium, and with the outer cooling medium flow channel further comprising a cooling medium bypass bypassing the pump, and with the cooling medium bypass provided with a valve that is closed while liquid is normally supplied through the outer cooling medium flow channel and is opened while the supply of liquid through the outer cooling medium flow channel is stopped or below normal.

6. The liquid heater according claim 1, wherein the temperature of the heat intended liquid is in the range of 70 to 120° C., and rises up to a temperature lower than a boiling point in the range of 140 to 220° C. while the heat intended liquid flows through the heat intended liquid flow channel.

7. The liquid heater according to claim 1, wherein the thickness of the heat intended liquid flow channel in the heat radiation direction is 10 mm or less.

* * * * *